United States Patent [19]

Tanaka et al.

[11] 4,085,723

[45] Apr. 25, 1978

[54] FUEL CONTROL SYSTEM FOR INTERNAL COMBUSTION ENGINE

[75] Inventors: Eizi Tanaka, Anjo; Michihiro Ohashi, Handa; Hiroshi Mochizuki, Okazaki, all of Japan

[73] Assignee: Nippon Soken, Inc., Nishio, Japan

[21] Appl. No.: 695,555

[22] Filed: Jun. 14, 1976

[30] Foreign Application Priority Data

Jun. 25, 1975 Japan ..... 50-79675

[51] Int. Cl.[2] ..... F02M 69/00

[52] U.S. Cl. ..... 123/139 AW; 123/139 BG; 261/50 A; 261/52

[58] Field of Search ..... 123/139 AW, 139 BG, 123/140 MC; 261/50 A, 52

[56] References Cited

U.S. PATENT DOCUMENTS

| | | | |
|---|---|---|---|
| 3,650,258 | 3/1972 | Jackson | 123/139 AW X |
| 3,739,762 | 6/1973 | Jackson | 123/139 AW X |
| 3,842,813 | 10/1974 | Eckert | 123/140 MC X |
| 3,963,005 | 6/1976 | Eckert | 123/119 R |
| 3,978,175 | 8/1976 | Stoltman | 123/139 AW X |

*Primary Examiner*—Charles J. Myhre

*Assistant Examiner*—Tony M. Argenbright

*Attorney, Agent, or Firm*—Cushman, Darby & Cushman

[57] ABSTRACT

A fuel control system for an internal combustion engine with an unbalanced sensing vane pivotally disposed in an intake pipe upstream of a throttle valve, an actuating device having a pressure chamber and a movable diaphragm coupled to the sensing vane for actuating the same in response to a pressure applied to the pressure chamber, and a conduit communicating the pressure chamber with the intake pipe between the sensing vane and the throttle valve, a pressure difference responsive valve responsive to a pressure difference across the sensing vane to compensate the pressure applied to the pressure chamber to control the pressure difference across the sensing vane at a constant value irrespective of changes in the amount of intake air, and a fuel metering valve coupled to the sensing vane to meter and distribute fuel in response to the pivotal movement of the sensing vane. The fuel control system is also provided with a solenoid valve to actuate the same in response to deviations from a given air fuel ratio, whereby the pressure difference across the sensing vane is maintained at another constant value.

6 Claims, 2 Drawing Figures

FUEL CONTROL SYSTEM FOR INTERNAL COMBUSTION ENGINE

BACKGROUND OF THE INVENTION

The present invention relates generally to a fuel control system for an internal combustion engine and more particularly a fuel control system for an internal combustion engine of the type used in conjunction with an intake-air flow-rate measuring device disclosed in copending and commonly assigned application Ser. No. 665,443, filed Mar. 9, 1976, now U.S. Pat. No. 4,058,100, so that the fuel may be metered in quantity substantially proportional to the flow rate of intake air flowing through an intake tube in order to maintain a constant air-fuel ratio over the whole operating range of the engine.

There have been devised and demonstrated various types of fuel injection systems of the type which meter the fuel in quantity proportional to the flow rate of intake air flowing through an intake tube. In one type as disclosed in U.S. Pat. No. 3,927,649, there is provided a fuel metering piston which is shifted together with an intake air-measuring device so that the fuel may be delivered in quantity always proportional to the flow rate of intake air and consequently an air-fuel mixture with a uniform air-fuel ratio may be charged in cylinders of the engine. The fuel injection system of the above type has been further improved in order to more precisely control the air-fuel ratio of the air-fuel mixture. That is, in response to the output signal from an exhaust gas measuring probe mounted in an exhaust pipe for detecting the air-fuel ratio based upon the composition of the exhaust gases, the volume of air bypassing the air-measuring device is so controlled that the air-fuel mixture with a uniform air-fuel ratio may be always delivered to cylinders of the engine.

In the above fuel injection system in which the air-fuel ratio of the air-fuel mixture is controlled by controlling the volume of air bypassing the air-measuring device, the volume of intake air measured by the air-measuring device is less than the whole volume of intake air supplied to the engine cylinders by the volume of air bypassing it so that the measurement of intake air is deviated from a correct value and thus unsatisfactory metering of fuel results. Furthermore the response characteristics of the air-measuring device are slow, thereby resulting in slow response of fuel metering. These drawbacks are amplified especially when the volume of intake air is little. For this reason, the system of the above type has been unsatisfactory to maintain a constant air-fuel ratio.

SUMMARY OF THE INVENTION

In view of the above, the primary object of the present invention is to provide a fuel control system for an internal combustion engine capable of delivering an air-fuel mixture with a precisely and uniformly controlled air-fuel ratio over the whole operating range of the engine.

To the above and other ends, the fuel control system is accordance with the present invention utilizes an intake-air flow-rate measuring device of the type disclosed in the above copending application Ser. No. 665,443 and comprising a sensing vane disposed in an intake tube for rotation the angle of which is proportional to the flow rate of air flowing through the intake tube, a pressure-difference-responsive valve mechanism for detecting the pressure difference across the sensing vane and generating an output signal representative of the difference between a predetermined reference pressure difference and the detected pressure difference, and a pressure-responsive actuating device responsive to the output signal from the pressure-difference-responsive valve mechanism for changing the angular position of the sensing vane so that the pressure difference across the sensing vane may become equal to the predetermined reference pressure difference, whereby the angle of rotation of the sensing vane may become substantially proportional to the flow rate of intake air. According to the present invention, a fuel metering shaft which is attached to the sensing vane for rotation therewith controls the volume of the fuel to be delivered to the cylinders so that the air-fuel mixture with a uniform air-fuel ratio may be obtained over the whole operating range of the engine. In addition, in order to more precisely control the air-fuel ratio of the air-fuel mixture, the control system of the present invention provides an air-fuel ratio sensor mounted in an exhaust pipe for always detecting the air-fuel ratio (based upon the $O_2$ content in the exhaust gases). Therefore when the detected air-fuel ratio is deviated from a predetermined ratio, a load preset on a spring in the pressure-difference-responsive valve mechanism may be changed so that the angle of rotation of the fuel metering shaft may be changed, thereby changing the volume of the fuel to be delivered. Therefore the air-fuel mixture can be delivered in a strictly uniform air-fuel ratio in accurate and quick response to the change in flow rate of intake air over the whole operating range of the engine.

DESCRIPTION OF THE PREFERRED EMBODIMENT

Figure 1:
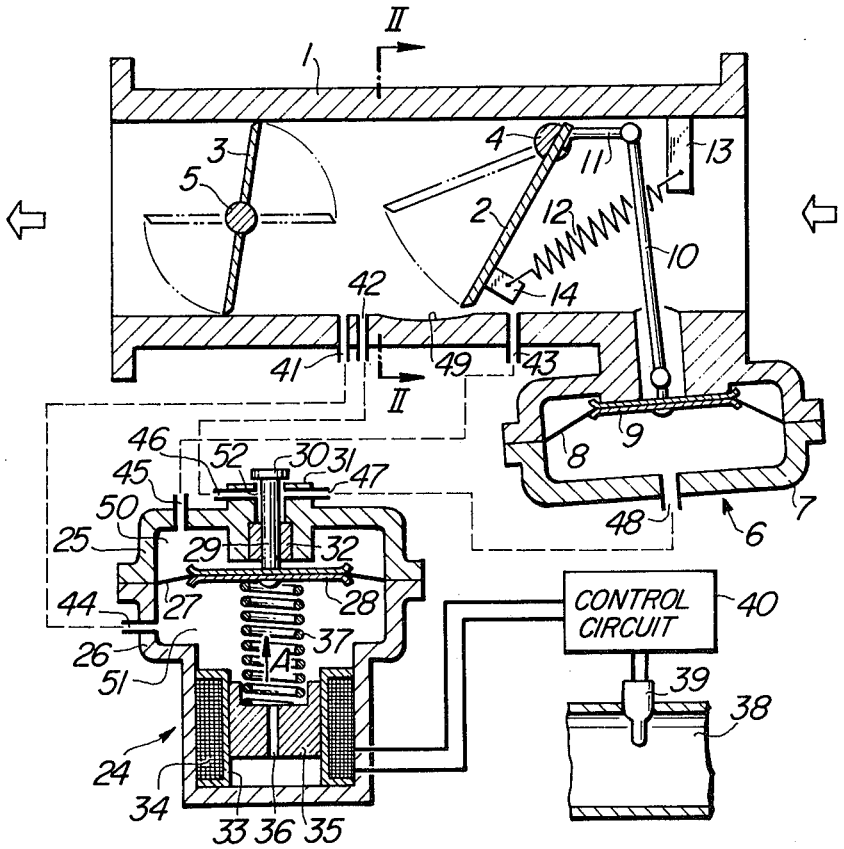
FIG. 1 is a sectional view of one preferred embodiment of the present invention.

In FIG. 1 there is shown a preferred embodiment of a fuel control system in accordance with the present invention. In an intake tube 1 having a rectangular cross-section through which air flows in the direction indicated by an arrow, a sensing vane 2 is carried by a fuel metering shaft 4 for rotation in unison therewith, and a throttle valve 3 which is disposed at the downstream side of the sensing vane 2 is carried by a throttle valve shaft 5 for rotation in unison therewith. A pressure-responsive actuating device generally indicated by the reference numeral 6 comprises a housing 7, a diaphragm 8 and an upper and a lower diaphragm retaining plates 9. The diaphragm 8 is operatively coupled to the sensing vane 2 through a connecting rod 10 which in turn is operatively coupled to an arm 11 extended from the sensing vane 2. A return spring 12 for biasing the sensing vane 2 has its both ends fixed to spring retainers 13 and 14, respectively, which in turn are extended from the intake tube 1 and the sensing vane 2, respectively.

Figure 2:
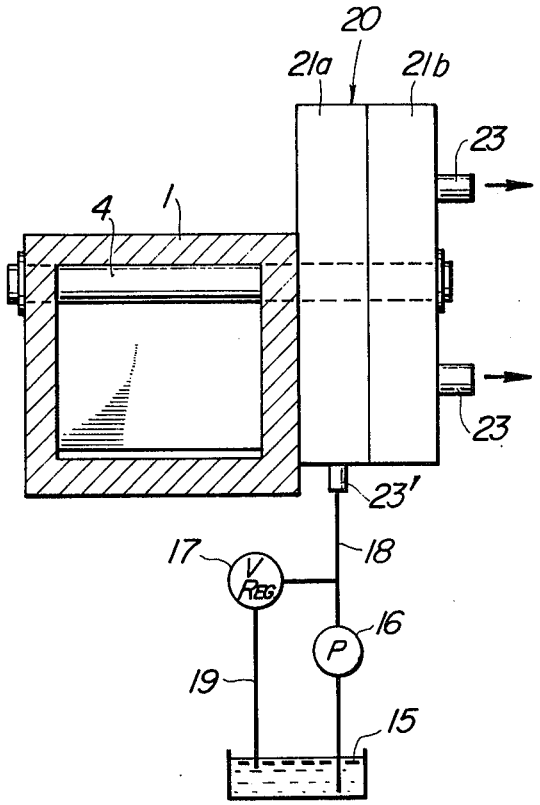
FIG. 2 is a sectional view taken along the line II—II of FIG. 1, illustrating also a system for delivering the fuel to a fuel metering device.

Next referring to FIG. 2, reference numeral 15 denotes a fuel tank; 16, a fuel pump; 17, a regulator; 18, a fuel feed line; 19, a fuel return line; 20, a fuel metering device; **21*a* and 21*b*, two-split housings of a fuel metering device 20; 23, fuel outlet ports; and 23'**, a fuel inlet port.

Referring back to FIG. 1, a pressure-difference-responsive valve mechanism generally indicated by the reference numeral 24 comprises upper and lower housings 25 and 26, a diaphragm 27 interposed between the upper and lower housings 25 and 26 to define an upper or first pressure chamber 50 and a lower or second pressure chamber 51, diaphragm retainers 28, a slide shaft 29 whose lower end is securely fixed to the upper diaphragm retainer 28 at the center thereof and which is extended through a negative pressure control chamber 52 and whose upper end is terminated into a control valve element 30, a valve seat 31 which is formed at the opening of the negative pressure control chamber 52 in communication with the surrounding atmosphere and which coacts with the control valve element 30 in a manner to be described in detail hereinafter, a bearing 32 for slidably supporting the slide shaft 29, a core assembly 33, a solenoid 34, a plunger 35 having a central bore 36 which serves to substantially eliminate the resistance of air exerting on the plunger 35 when it is shifted, and a return spring 37 loaded between the plunger 35 and the diaphragm 28.

Still referring to FIG. 1, an air-fuel ratio sensor 39 is mounted in an exhaust pipe 38 of the engine and is operatively coupled to a control circuit 40 which detects whether the air-fuel ratio of the air-fuel mixture is larger or smaller than a desired ratio (that is, whether the air-fuel mixture is lean or rich) in response to the output signal from the sensor 39 and energizes or de-energizes the solenoid 34 of the pressure-difference-responsive valve mechanism 24.

Negative pressure taps 41 and 42 which are opened into the intake tube 1 at the downstream side of the sensing vane 2 communicate through intake ports 44 and 46, respectively, with the lower or second pressure chamber 51 and the negative pressure control chamber 52, respectively. In like manner, a negative pressure tap 43 which is opened into the intake tube 1 at the upstream side of the sensing vane 2 communicates through a second intake port 45 with the upper or first pressure chamber 50. A negative pressure transmission port 47 of the negative-pressure control chamber 52 communicates with a negative-pressure admitting port 48 opened into the lower pressure chamber of the pressure-responsive actuating device 6.

The intake tube 1 has a flow-rate compensating or correcting surface 49 formed in opposed relation with the free edge of the sensing vane 2 so that the opening area of the intake air flow passage defined by the sensing vane 2 may change as a function of the angle of rotation of the vane 2.

The sensing vane 2, the pressure-difference-responsive valve mechanism 24 and the pressure-responsive actuating device 6 constitute an intake-air flow-rate measuring device which is disclosed in the above co-pending application Ser. No. 665,443. As will be described in detail hereinafter, the angle of rotation of the sensing vane 2 is in proportion to the intake-air flow rate, and consequently the angle of rotation of the fuel metering shaft 4 which rotates in unison with the sensing vane 2 is also in proportion to the intake-air flow rate.

When the engine is started and the throttle valve 3 is opened, the air flows through the intake tube 1 in the direction indicated by arrows. The sensing vane 2 rotates against the return spring 12 under the pressure of the intake air, but the angle of rotation thereof would not be proportional to the intake-air flow rate if the pressure-difference-responsive valve mechanism 24 and the pressure-responsive actuating device 6 were not provided.

The negative pressure at the downstream and upstream sides of the sensing vane 2 are transmitted through the negative-pressure taps 41 and 43, respectively, and the first and second intake ports 44 and 45, respectively, into the lower or second and upper or first pressure chambers 51 and 50, respectively, and exert upon the lower and upper surfaces of the diaphragm 27 of the pressure-difference-responsive valve mechanism 24. As a result, the diaphragm 27 is displaced to the position where the negative pressure acting upon the upper surface of the diaphragm 27 is in equilibrium with the negative pressure acting upon the lower surface thereof plus the force of the return spring 37 so that the slide shaft 29 is shifted downward or upward accordingly and consequently the area of the opening between the control valve element 30 and its valve seat 31 varies depending upon the pressure difference across the sensing vane 2. Therefore the negative pressure which is transmitted from the negative pressure control chamber 52 through the transmission port 47 and the admitting port 48 into the lower pressure chamber of the pressure-responsive actuating device 6 becomes also dependent upon the pressure difference across the sensing vane 2.

When the pressure difference across the sensing vane 2 is deviated from a predetermined level, the opening degree of the control valve element 30 changes and the negative pressure acting upon the under surface of the diaphragm 9 in the pressure-responsive actuating device 6 changes accordingly in the manner described above. The displacement of the diaphragm 9 is transmitted to the sensing vane 2 through the connecting rod 10 and the arm 11 so that the sensing vane 2 is rotated to a position where the differential pressure across the vane 2 may be maintained at a predetermined level and where the angle of rotation of the vane 2 is proportional to the intake-air flow rate. Since the intake-air flow-rate compensating or correcting surface 49 is provided, the area of the intake-air passage defined by the intake tube 1 and the free edge of the sensing vane 2 is precisely in proportion to the angle of rotation of the vane 2 and hence the flow rate of intake-air. As a result, the angle of rotation of the fuel metering shaft 4 is also precisely proportional to the flow rate of intake-air.

The mode of operation will be further described with reference to FIG. 2. The pressure of the fuel pumped up by the fuel pump 16 from the fuel tank 15 is controlled at a predetermined level by the regulator 17, and the pressure-controlled fuel flows through the inlet port 23' into the fuel metering device 20 so that the precisely metered fuel is charged through the outlet ports 23 to fuel injection nozzles (not shown). In the present embodiment, the fuel metering is controlled by a plurality of fine circumferentially extended axially spaced-apart slits formed on the peripheral surface of the fuel metering shaft 4, the slits being equal in number to the cylinders of the engine. Since the volume of fuel supplied is proportional to the angle of rotation of the fuel metering shaft 4, it is also proportional to the flow rate of intake air. Thus an air-fuel mixture of a substantially constant air-fuel ratio can be always obtained.

In order to more precisely control the air-fuel ratio, the present invention provides the air-fuel ratio sensor 39 which is mounted in the exhaust pipe 38 and whose output or electromotive force changes in response to the deviation of the actual air-fuel ratio from the stoichiometric air-fuel ratio. That is, the air-fuel ratio sensor 39 detects the change in air-fuel ratio in response to the oxygen ($O_2$) content of the exhaust gases, and the output from the sensor 39 is applied to the control circuit 40.

When the air-fuel ratio of the air-fuel mixture detected by the sensor 39 is smaller than a predetermined level or the stoichiometric ratio (That is, when the air-fuel mixture is rich), the control circuit 40 energizes the solenoid 34 of the pressure-difference-responsive valve mechanism 24 so that the plunger 35 is displaced upward in the direction indicated by the arrow A and consequently the pressure of the return spring 37 acting upon the diaphragm 27 is increased. That is, the reference pressure difference to be regulated by the pressure-difference-responsive valve mechanism 24 is increased. The slide shaft 29 is shifted upward so that the area of the opening defined between the control valve element 30 and the valve seat 31 is increased, lowering the negative pressure to be transmitted to the lower chamber of the pressure-responsive actuating device 6. As a result, the sensing vane 2 is rotated to decrease the area of the intake air passage until the pressure difference across the vane 2 is in equilibrium with the reference pressure difference newly set in the pressure-difference-responsive valve mechanism 24 in the manner described above. Therefore the volume of fuel to be controlled by the metering shaft 4 is decreased so that the air-fuel ratio may be increased.

On the other hand when the air-fuel mixture is lean, the control circuit 40 de-energizes the solenoid 34. Therefore, in a manner opposite to the manner described above, the volume of fuel to be supplied is increased to restore the desired air-fuel ratio.

Therefore the fuel is always precisely metered depending upon the flow rate of intake air so that the air-fuel mixture in an optimum air-fuel ratio or stoichiometric ratio can be charged into the cylinders of the engine.

As described above, in a fuel injection system of the type including the pressure-responsive actuating device operatively coupled to the sensing vane so that the fuel metering shaft which rotates in unison with the sensing vane may meter the fuel depending upon the flow rate of intake air and the pressure-difference-responsive valve mechanism for maintaining the pressure difference across the sensing vane constant, the present invention provides the air-fuel ratio sensor which is mounted in the exhaust pipe to detect the air-fuel ratio in response to the $O_2$ content in the exhaust gases in such a way that when the air-fuel ratio changes from a predetermined ratio, the pressure difference across the sensing vane is changed and consequently the angle of rotation of the fuel metering shaft is changed, thereby changing the volume of fuel to be supplied. Therefore over the whole range of the intake air flow rate, the air-fuel mixture may be supplied in a desired constant air-fuel ratio which may be very precisely and quickly controlled in response to the flow rate of intake air.

What is claimed is:

1. A fuel control system for an internal combustion engine comprising:

an air intake pipe through which air is introduced into an engine;

a throttle valve pivotally disposed in said intake pipe for controlling the flow rate of intake air flowing therethrough;

an unbalanced sensing vane pivotally disposed in said intake pipe upstream of said throttle valve;

pressure responsive actuating means having a pressure chamber, a movable member operable in response to a pressure introduced into said pressure chamber, and connecting means for operatively interconnecting said movable member with said sensing vane, whereby said actuating means actuates said sensing vane to open and close in response to the pressure introduced into said pressure chamber;

conduit means communicating said pressure chamber with said intake pipe between said sensing vane and said throttle valve, to thereby introduce a pressure produced in said intake pipe between said sensing vane and said throttle valve into said pressure chamber;

pressure difference responsive means for controlling the introduction of the pressure into said pressure chamber in response to a pressure difference between a pressure in said intake pipe upstream of said sensing vane and a pressure in said intake pipe downstream of said sensing vane so as to maintain the pressure difference across said sensing vane at a constant value, whereby said sensing vane is pivoted in proportion to the flow rate of the intake air;

fuel delivering means operatively coupled to said sensing vane for delivering fuel in response to the pivotal displacement of said sensing vane;

an air-fuel ratio sensor mounted in an exhaust pipe of the engine for sensing the air-fuel ratio based on the composition of the exhaust gas and generating an output signal when the detected air-fuel ratio is deviated from a predetermined value; and means operatively coupled to said air-fuel ratio sensor and said pressure difference responsive means for changing the constant value of the pressure difference across said sensing vane to another constant value in response to said output signal.

2. A fuel control system as set forth in claim 1 further comprising:

a recess formed in the inner wall of said intake pipe at the area facing to the forward edge of said sensing vane opposite to the edge thereof pivoted to said intake pipe, the profile of said recess being so determined that the intake air passage defined by said sensing vane and the inner wall of said intake pipe may be in linear proportion to the angular displacement of said sensing vane.

3. A fuel control system as set forth in claim 1, wherein said pressure difference responsive means comprises:

first and second negative pressure chambers divided by a deformable diaphragm respectively communicated with said intake pipe upstream and downstream of said sensing vane, whereby said diaphragm is deformed in response to the pressure difference between said first and second negative pressure chambers; and a valve member coupled to said diaphragm for allowing air from the atmosphere to flow to said pressure chamber of said actuating means and controlling the amount of the air in response to the deformation of said diaphragm.

4. A fuel control system as set forth in claim 3, wherein said pressure difference responsive means further comprises a coil spring disposed in said second negative pressure chamber for biasing said diaphragm in a direction toward said first negative pressure chamber; and said constant value changing means comprises;

electromagnetic means operatively coupled to said coil spring for changing the biasing force thereof when said electromagnetic means is energized by said output signal from said air-fuel ratio sensor.

5. In a fuel control system for an internal combustion engine including an intake tube, an exhaust pipe, a throttle valve disposed within said intake tube for controlling the flow rate of the intake air flowing therethrough, means for delivering the fuel to be mixed with the intake air, and means for metering the fuel delivered, said fuel control system of the type further including a sensing vane disposed within said intake pipe in series to said throttle valve for rotation, the angle of which is dependent upon the flow rate of the intake air flowing through said intake tube, a fuel metering shaft attached to said sensing vane for rotation therewith and operatively coupled to said fuel metering means so that said fuel metering means may meter the fuel in quantity depending upon the angle of rotation of said metering shaft, a pressure-difference-responsive valve mechanism for detecting the pressure difference across said sensing vane and generating a first output signal representative of the difference between a predetermined reference pressure difference and said pressure difference across said sensing vane, and pressure-responsive actuating means operatively coupled to said sensing vane for controlling the angular position of said sensing vane in response to said first output signal in such a way that said pressure difference across said sensing vane may become substantially equal to said predetermined pressure difference, the improvement comprising:

(a) an air-fuel ratio sensor means mounted in the exhaust pipe of the engine for sensing the air-fuel ratio based on the composition of the exhaust gases and generating a second output signal when the detected air-fuel ratio is deviated from a predetermined air-fuel ratio; and (b) means operatively coupled to said air-fuel ratio sensor means and said pressure-difference-responsive valve mechanism for changing said reference pressure difference to be set on and regulated by said pressure-difference-responsive valve mechanism in response to said second output signal, and wherein said pressure-difference-responsive valve mechanism comprises:

(a) a housing, (b) a diaphragm disposed within said housing, defining within said housing a first pressure chamber in communication with said intake tube at the upstream side of said sensing vane and a second pressure chamber in communication with said intake tube at the downstream side of said sensing vane, (c) a negative pressure chamber provided with an intake port in communication with a negative pressure source of the engine, an outlet port through which the negative pressure in said negative pressure control chamber is transmitted as said first output signal to said pressure-responsive actuating means, and a valve port in communication with the surrounding atmosphere, (d) a control valve element fixed to said diaphragm for displacement therewith so as to control the opening area of said valve port, and (e) spring means disposed in said second pressure chamber for biasing said diaphragm toward said first pressure chamber; and said means for changing the reference pressure difference to be set on said pressure-difference-responsive valve mechanism comprises:

(a) spring retaining means slidably disposed within said housing for receiving the end of said spring means remote from the end attached to said diaphragm, and (b) means for shifting said spring retaining means in response to said second output signal.

6. The improvement as set forth in claim 5 wherein said means for shifting said spring retaining means comprises:

a solenoid which is energized in response to said second output signal from said air-fuel ratio sensor means.

* * * * *